US005232147A

United States Patent [19]

Weinzierl et al.

[11] Patent Number: 5,232,147

[45] Date of Patent: Aug. 3, 1993

[54] MULTI-COMPONENT MAILER AND PERSONALIZING METHOD

[75] Inventors: J. Buster Weinzierl, Sewickley, Pa.; Toby H. Hoyt, Bemus Point, N.Y.

[73] Assignee: Belknap Business Forms, Inc., Westfield, N.Y.

[21] Appl. No.: 781,383

[22] Filed: Oct. 23, 1991

[51] Int. Cl.[5] ..... B65D 27/10

[52] U.S. Cl. ..... 229/69; 229/71; 229/314

[58] Field of Search ..... 229/300, 301, 303, 304, 229/305, 314, 316, 69, 71, 80.5; 283/62, 74, 75, 79, 81, 101, 904

[56] References Cited

U.S. PATENT DOCUMENTS

| | | | |
|---|---|---|---|
| 2,824,685 | 2/1958 | Patton | 229/69 |
| 2,988,969 | 6/1961 | Stratton et al. | 93/61 |
| 3,273,785 | 9/1966 | Beckman et al. | 229/69 |
| 3,312,385 | 4/1967 | Amort | 229/69 |
| 3,325,188 | 6/1967 | Hiersteiner | 229/69 X |
| 3,428,237 | 2/1969 | Dowen | 229/69 |
| 3,482,763 | 12/1969 | Carrigan | 229/69 |
| 3,508,702 | 4/1970 | Kaiser | 229/71 |
| 3,511,015 | 5/1970 | Beckman et al. | 229/69 X |
| 3,697,101 | 10/1972 | Loos et al. | 283/62 |
| 3,869,964 | 3/1975 | Kranz | 93/61 A |
| 3,905,545 | 9/1975 | Juszak et al. | 229/69 |
| 3,999,700 | 12/1976 | Chalmers | 229/71 X |
| 4,051,995 | 10/1977 | Wieman | 229/69 |
| 4,384,670 | 5/1983 | Dicker | 229/69 |
| 4,435,001 | 3/1984 | Mills et al. | 229/69 |
| 4,455,809 | 6/1984 | Dallaserra | 53/435 |
| 4,671,454 | 6/1987 | Warren | 229/80.5 X |
| 4,726,804 | 2/1988 | Stitcher | 493/223 |
| 4,733,856 | 3/1988 | Gunther, Jr. | 270/1.1 |
| 4,770,337 | 9/1988 | Liebe | 229/69 |
| 4,809,906 | 3/1989 | Lombardo | 229/304 |
| 4,969,594 | 11/1990 | Ashby | 229/69 |
| 4,982,894 | 1/1991 | Schmidt | 283/75 X |
| 5,024,374 | 6/1991 | Ashby | 229/305 X |
| 5,076,489 | 12/1991 | Steidinger | 229/69 X |
| 5,183,436 | 2/1993 | Shanley | 229/69 X |

FOREIGN PATENT DOCUMENTS

| | | | |
|---|---|---|---|
| 2195611 | 4/1988 | United Kingdom | 229/71 |

*Primary Examiner*—Allan N. Shoap
*Assistant Examiner*—Jes F. Pascua
*Attorney, Agent, or Firm*—Mason, Fenwick & Lawrence

[57] ABSTRACT

A multi-component mailer and personalizing method therefor, achieved by sequentially passing a continuous web of plural, physically connected mailer configurations through a printing station, where each said mailer configuration includes a front sheet member having a window therein and an insert member behind said window, and applying personalized data to said front sheet and to said insert sheet of each said mailer configuration while each said mailer configuration is at said printer station during its passage therethrough. Each mailer configuration further includes left and right longitudinal marginal tear strips as part of its said front sheet, with a series of printer feed holes in each said marginal tear strip, and a back sheet member located behind said insert sheet and affixed to said front sheet, where the transverse width of said back sheet is not greater than and, preferably, is less than the transverse distance between said marginal tear strips. In a second embodiment, an additional patch sheet is permanently affixed to the outside of the back sheet for providing a return envelope.

12 Claims, 4 Drawing Sheets

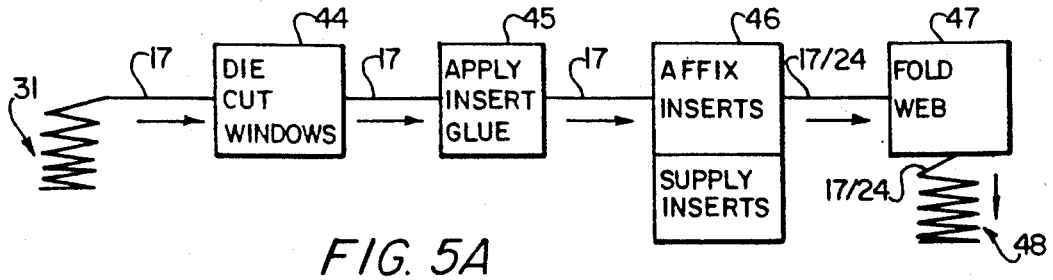
FIG. 5A
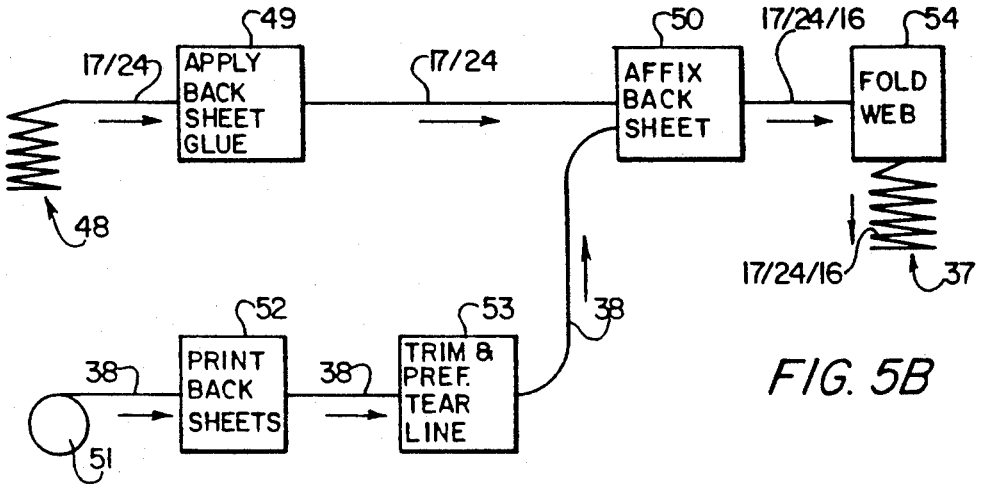
FIG. 5B
FIG. 6
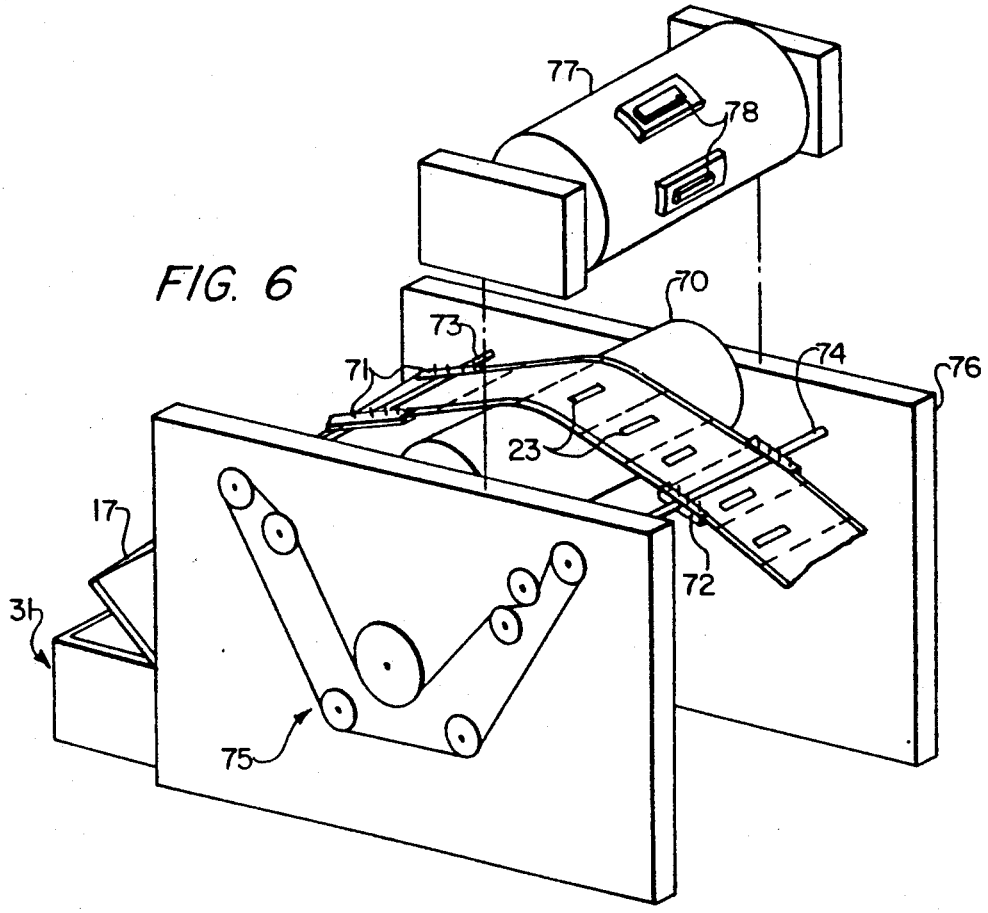

MULTI-COMPONENT MAILER AND PERSONALIZING METHOD

FIELD OF THE INVENTION

The present invention relates to a multi-component mailer configuration, and personalizing method therefor, for sending membership cards or other personalized materials to different addressees. In particular, the present invention permits personalized information such as addresses and names to be printed on the outside of the mailer envelope and on its contents during the same printing operation instead of separate operations, thus reducing the printing time involved and eliminating the possible mismatching of information on the mailer envelope and its contents.

BACKGROUND OF THE INVENTION

Many organizations, institutions and other entities are comprised of members or otherwise deal with different parties. It is quite often necessary for these entities to send materials to their members or interested parties which bear information that is personal or unique to each addressee. For example, a membership organization usually provides each member with a membership card showing the member's name and perhaps other personal data. Each such card is typically mailed or otherwise delivered in an envelope that also has at least the member's address on the outside. The customary procedure in accomplishing this objective is to print or otherwise apply a member's name on a membership card in one operation before the card is inserted into its envelope, and to put the member's address on said envelope during another operation either before or after the card is inserted therein. This procedure obviously has the potential through human or other error of mismatching cards and envelopes so that a card ends up in an envelope addressed to someone other than the member whose name appears on the card. Moreover, the card and its envelope must be separately run through the same or different printers in two separate operations, which can increase the printing time or cost of personalized data. A Gunther U.S. Pat. No. 4,733,856 discloses one prior art technique for personalizing envelopes and their inserts by using two separate printers.

The subject invention obviates the above noted disadvantages by providing a mailer having an envelope with an open window or aperture therein which permits a card or other insert inside the envelope to be printed during the same operation that also prints data on the envelope. Although some prior art patents broadly teach the concept of mailers or documents having windows for viewing materials therebehind (e.g. see Krantz U.S Pat. No. 3,869,964; Dallaserra U.S. Pat. No. 4,455,809; and Ashby U.S. Pat. No. 4,969,594), they do not disclose the specific structure of the novel mailer described and claimed herein, nor do they suggest a single printing operation wherein data is printed on an insert behind an envelope window and on said envelope after the mailer has been constructed.

SUMMARY OF THE PRESENT INVENTION

Accordingly, it is a primary object of the present invention to provide a novel mailer and method for producing personalized envelopes and their inserts in a way to eliminate the possible mismatching of personalized data.

Another primary object of the present invention is to permit the individual personalization of both a mailer envelope and its contents in only one pass through a print station, thus substantially reducing the time needed for such personalization.

A further primary object of the present invention is to provide a novel mailer configuration for allowing the rapid and accurate printing of personalized data on both the outside of said mailer and its contents.

These and other objects of the present invention are generally achieved by sequentially passing a continuous web of plural, physically connected mailer configurations through a printing station, where each said mailer configuration includes a front sheet member having a window therein and an insert member behind said window, and applying personalized data to said front sheet and to said insert sheet of each said mailer configuration while each said mailer configuration is at said printer station during its passage therethrough. Each mailer configuration further includes left and right longitudinal marginal tear strips as part of its said front sheet, with a series of printer feed holes in each said marginal tear strip, and a back sheet member located behind said insert sheet and affixed to said front sheet, where the transverse width of said back sheet is not greater than and, preferably, is less than the transverse distance between said marginal tear strips. In a second embodiment, an additional patch sheet is permanently affixed to the outside of the back sheet for providing a return envelope.

BRIEF DESCRIPTION OF DRAWINGS

FIGS. 5A and 5B illustrate a modification of the FIG. 4B procedure;

FIG. 6 shows a simplified pictorial view of one suitable window die cutter apparatus.

DETAILED DESCRIPTION

Figure 1:
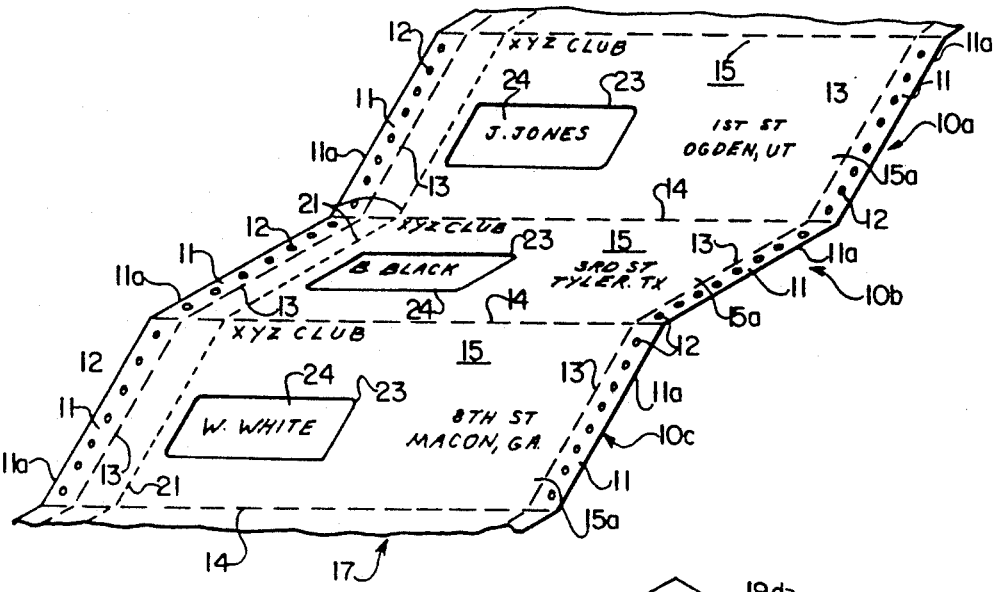
FIG. 1 illustrates a plurality of physically connected mailers constructed according to the present invention.

In describing the subject invention illustrated in the drawings, specific terminology is used for the sake of clarity. However, the invention is not intended to be limited to the specific terms so selected, and each specific term includes all technical equivalent terms for steps or components operating in a similar manner to accomplish a similar purpose.

FIG. 1 illustrates a plurality of physically connected mailers 10*a*–10*c* constructed according to the present invention, on whose envelopes and inserts have been printed personalized information such as names and addresses. As shown by FIG. 1, for example, each mailer 10*a*, 10*b* and 10*c* is on a continuous web or form 17 and has a different addressee name printed on its insert 24 (e. g., a membership card) which is accessible through an open window 23, and the addressee's address printed on the outer surface 15*a* of the envelope's front sheet 15. Of course, any kind or amount of personal or tailored data can be applied to card 24 and surface 15*a*. This printing can be done by a continuous form printer after the inserts have been sealed within their respective envelopes. Marginal strips 11 having a series of regularly spaced holes 12 near the marginal edges 11*a* may be provided at the sides of these continuous form mailers so that these mailers can be fed through a printer having a pinwheel feed mechanism. After the continuous form mailers emerge from this printer, they can be separated from their marginal strips 11 by the longitudinal marginal tear or weakened lines 13, and from each other by the transverse tear or weakened lines 14, so that they can be sent to the respective addressees.

Figure 2:
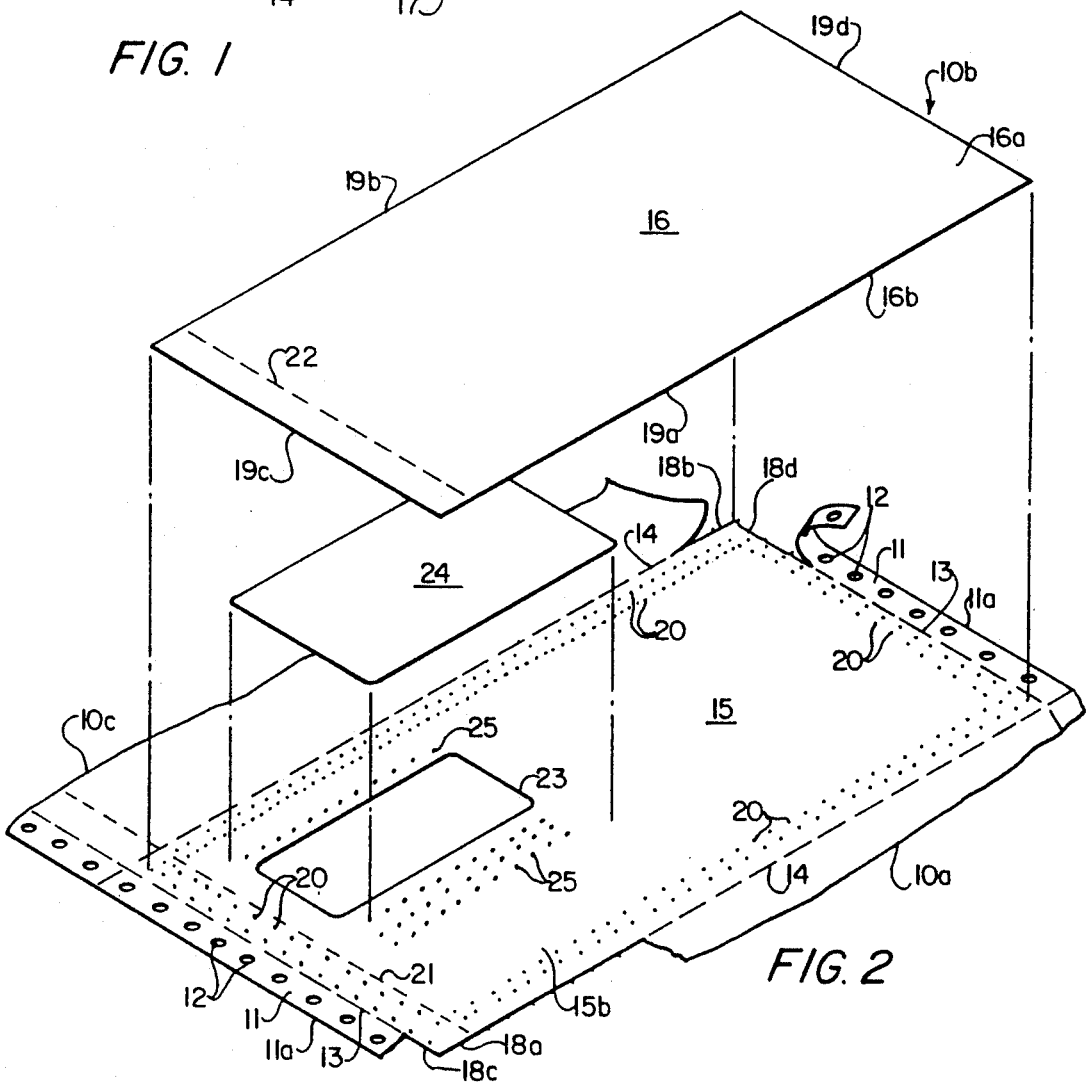
FIG. 2 is an exploded, upside down view of one of the mailers shown in FIG. 1.

As best shown in the FIG. 2 exploded, upside down view of the individual mailer 10*b*, one preferred embodiment of each mailer envelope comprises at least a member 15 made of flexible material (typically paper) which constitutes the front outside sheet of the envelope, and a flexible member 16 with outer and inner surfaces 16*a* and 16*b*, respectively, which acts as the envelope's back outside sheet. The front sheets 15 of the mailers 10 are serially formed on a continuous web 17 of flexible material that is provided with the longitudinal printer feed holes 12 and perforated marginal tear lines 13 which are spaced inwardly from the marginal edges 11*a*, and with the transverse perforated tear lines 14 for defining and separating the mailers. In FIG. 2, the top edge 18*a* and bottom edge 18*b* of front sheet 15 are formed at the locations of former transverse tear lines 14 after mailer 10*b* is separated from mailers 10*a* and 10*c*. Similarly, side edges 18*c* and 18*d* of front sheet 15 are formed at the locations of former tear lines 13 after the marginal strips 11 are separated from mailer 10*b*. In the preferred embodiment of FIG. 2, however, the back sheet 16 of each mailer is a discrete, individual patch that is adhesively affixed to the inner surface 15*b* of its associated front sheet. The width or distance from side edge 19*c* to side edge 19*d* of each patch back sheet 16 is not greater than and, preferably, is somewhat smaller than the width of the front sheet 15 as measured between the marginal tear lines 13 (side edges 18*c* and 18*d*). The resulting single thickness of the front sheet marginal pin hole strips 11, which do not overlay an part of the back sheet 16, thus allows easier feeding of the continuous form through a printer and minimizes the chances of a paper jam therein. The height or distance between the top edge 19*a* and bottom edge 19*b* of back sheet 16 also is not greater than and, preferably, is somewhat smaller than the distance between the top edge 18*a* and the bottom edge 18*b* of front sheet 15.

Figure 3:
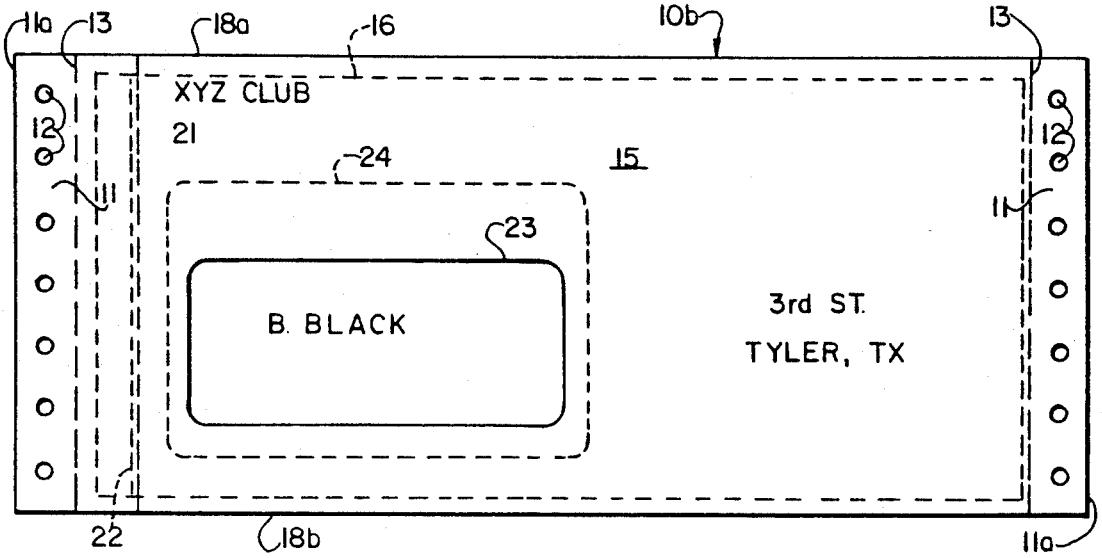
FIG. 3 is a plan view of one of the mailers shown in FIG. 1 and also in FIG. 2.

FIG. 3, which is a plan view of mailer 10*b*, illustrates a typical preferred size relationship of front sheet 15 with respect to back sheet 16 for a relatively small mailer. For example, the width of the front sheet 15 between its marginal tear lines 13 may be 7.5 inches while the side-to-side width of back sheet 16 may be about 7.25 inches. The marginal hole strips 11 may each be about 0.5 inches wide. The top-to-bottom height of front sheet 15 may be about 3.67 inches, as compared to about 3.38 inches for the top-to-bottom height of back sheet 16. Of course, mailers of other sizes may be constructed according to the present invention. A patch back sheet 16 that is somewhat smaller than front sheet 15 is desirable because of possible misalignment by back sheet affixing apparatus during the mailer manufacturing process. Another advantage of a smaller back sheet 16 is that there is less paper bulk near the pin feed holes 12, thus contributing even more to jam-free printer operation. Furthermore, a smaller back sheet reduces the mailer's total bulk which lowers the cost of mailing.

Adhesive means is also provided for removably affixing the back sheet 16 to the inner surface of front sheet 15. As shown in FIG. 2, this adhesive preferably takes the form of one or more rows of discrete dots 20, comprised of removable cold latex glue (such as latex glue 35-6196 from the National Starch and Chemical Co.) or other suitable composition, which are preferably applied to the inner surface of front sheet 15 during the manufacturing process. They may be spaced around said front sheet's top and bottom edges 18*a*–18*b* and inwardly of the longitudinal tear lines 13 that define the marginal strips 11. Their position and number can vary depending on paper weight and mailer size. The glue of dots 20 sets and binds sheets 15 and 16 around their peripheries when pressed together during the manufacturing operation. Adhesive in other forms, such as strips, also can be used.

Front sheet 15 and back sheet 16 also preferably have longitudinal perforated tear lines 21 and 22, respectively, which are superposed or almost superposed with respect to each other, and are near to but spaced inwardly from the left marginal tear line 13 of front sheet 15 so that the adjacent longitudinal rows of glue dots 20 lie in the space between tear lines 13 and 21 of the front sheet. These additional tear lines 21 and 22, which are at least approximately aligned with each other, facilitate opening one end of the mailer envelope by the addressee so that the contents can be removed. The back sheet 16 also can be easily peeled away from the glue dots 20 which normally leave no residue on back sheet 16. The removal of back sheet 16 is made even easier if tear lines 21 and 22 are not in exact or perfect alignment with each other so that one of said sheets will extend slightly beyond the other sheet after the addressee ruptures said tear lines. This relationship is best shown in FIG. 3 where the back sheet tear line 22 is slightly left of front sheet tear line 21 so that after rupture the left side of back sheet 16 will extend just beyond the left side of front sheet 15.

At least one opening or window 23 is also provided in front sheet 15 of each mailer, preferably by a die cut process. The size and shape of open window 23 is generally governed by the nature of the envelope's content or insert. In FIG. 2, for example, the insert is shown to be a membership card 24 (often made of sheet plastic) on which the member's name and perhaps other personal or institutional data is to be applied on a special signature panel before the card is mailed. Card 24 is located between the front sheet 15 and the back sheet 16, and is also positioned under window 23 so that the special signature panel on the card's top surface is accessible through the window. Therefore, window 23 should be smaller than card 24 in at least one dimension but preferably two, as illustrated in FIG. 3, yet large enough to allow at least the desired personalized data to be applied to card 24 after it has been sealed between sheets 15 and 16 of the mailer envelope. One or more rows of additional discrete latex glue dots 25 are also provided at least partially around window 23, where they are preferably applied to the inner surface of front sheet 15 during the manufacturing process. These glue dots 25 thus affix card insert 24 to said inner surface s that the card will not shift its position after the mailer is completely assembled. However, the card can be easily peeled away from dots 25 when the mailer envelope is opened.

Figure 4A:
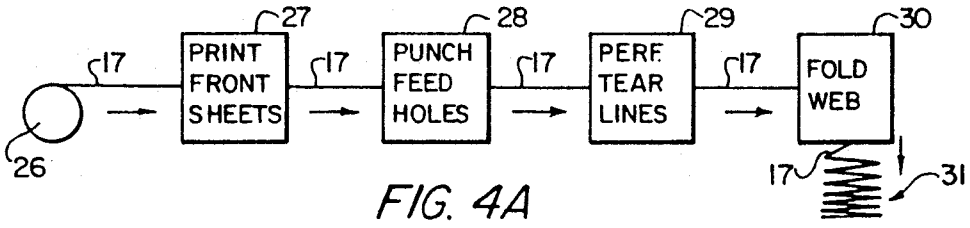
FIGS. 4A–4C illustrate one preferred method of making and printing personalized data on the continuous form mailers shown in FIGS. 1–3.
Figure 4B:
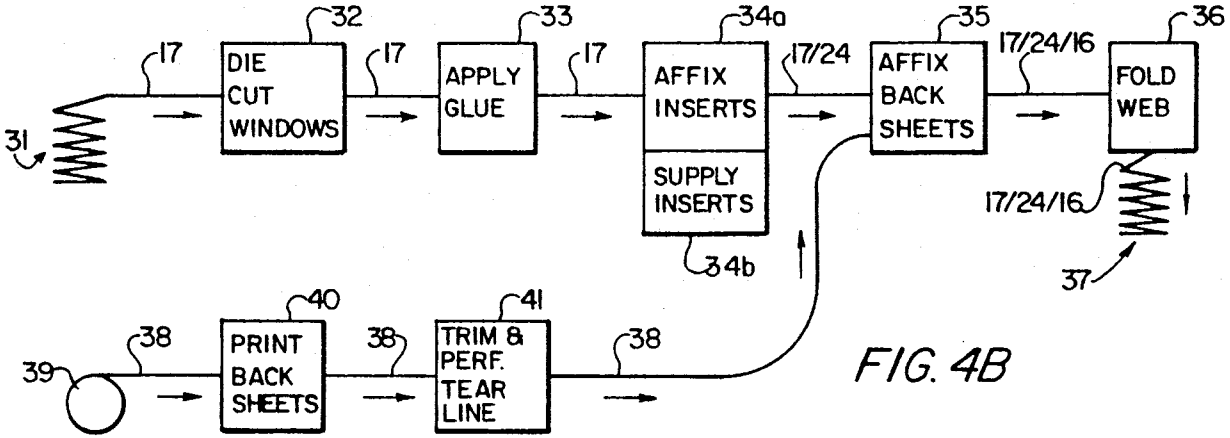
Figure 4C:
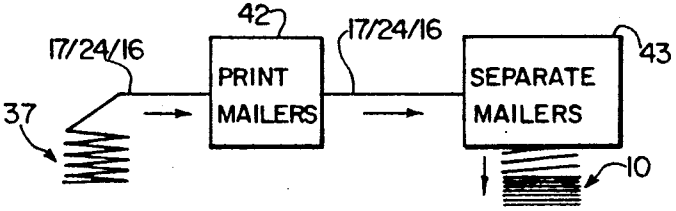

FIGS. 4A–4C illustrate one preferred method of manufacturing and printing personalized data on the continuous form mailers shown in FIGS. 1–3. In FIG. 4A, a continuous paper web 17, from which the envelope front sheets 15 are made, is taken from a supply roll 26. If the outer and/or inner surfaces of each mailer's front sheet is to bear the same non-personalized information, such as instructions or a mailing organization's name like the "XYZ Club" shown in FIG. 1, a front sheet print station or step 27 for applying such data may also be provided through which web 17 passes. Web 17 is then fed by conventional rollers and related apparatus (not shown) to a conventional punch station or step 28 where the pin wheel feed holes 12 are created along the left and right margins of web 17. Web 17 is then moved by other conventional mechanism to one or more conventional tear line perforators represented by the station or step 29 in FIG. 4A. There, the web is provided with the longitudinal tear lines 13 and 21, and with the transverse tear lines 14 which delineate the top and bottom edges 18*a* and 18*b* of each mailer front sheet 15 formed on web 17. Thereafter, web 17 is fan folded by conventional apparatus or step 30 along selected transverse tear lines 14 into stack labeled 31 in FIG. 4A. If, for example, each delineated mailer front sheet 15 is from three to four inches high between its tear lines 14, then folding may be done at every third tear line so that three mailers are on each folded leaf of web 17 in stack 31. Instead of being performed at separate stations, steps 26, 27, 28, 29 and 30 may be carried out by a unitary apparatus such as a commercially available Model 860 Didde press.

The next processing step on web 17, as illustrated in FIG. 4B, is to cut the window or opening 23 in each mailer front sheet 15 that is delineated on the web. This step is performed using the folded continuous web stack 31 which resulted from the operations depicted in FIG. 4A. As shown by FIG. 4B, said stack 31 is unfolded and the web 17 is sent to a window cutting station or step 32. Station 32 preferably includes a die cutter for this purpose. FIG. 6 is a simplified pictorial view of one suitable window die cutter apparatus although other die cutters are commercially available such as a Hart Model 16-24 RDML cutter. In FIG. 6, web 17 is drawn from stack 31 and is passes over an anvil cylinder 70 by tractor components 71 and 72 which regulate tension and alignment of the web. Tractors 71 and 72 are respectively driven by shafts 73 and 74 which in turn are operated by a system of pulleys and other components collectively identified by 75, including a drive motor and gear located on the outer surface of the far side frame 76. A removable die cylinder 77 with multiple dies 78 thereon is used to cut the window openings 23 in web 17. This removable die cylinder permits using different circumference die cylinders with the common anvil cylinder 70. Not shown is a knock out removal system to remove the cut-outs.

FIG. 4B also shows the final steps in making the continuous form mailer prior to printing personalized data thereon. These final steps involve mating the card inserts 24 and back sheets 16 with the front sheets 15 on web 17. The web 17 from the FIG. 4B die cutting step 32 is fed (by undisclosed conventional mechanism) through a glue applicator station or step 33 where the glue dots 20 and 25 of FIG. 2 are added to the inner surface of each delineated front sheet. This web 17 then travels to an insert affixer station or step 34*a* which, for each mailer front sheet that passes therethrough, retrieves a card 24 from its insert supply 34*b* and presses said card in contact with the glue dots 25 adjacent to window 23. In practice, glue step 33 and affixing step 34 may both be performed using a commercially available Ga-Vahren Mini-Communicator 262-2M. Web 17 in FIG. 4B of the subject application then passes through a patch back sheet affixer station 35 where the back sheet 16 is applied against insert card 24 and to glue dots 20 o the inner surface of each delineated front sheet 15. Web 17 then is refolded by station or step 36 into stack 37.

The patch back sheet affixer station or step 35 and folding step 36 in FIG. 4B can also be performed by a Ga-Vahren Mini-Communicator 262-2M. In FIG. 4B, the back sheet affixer 35 receives a continuous web 38 from a supply roll 39. This web 38 first passes through a tear line perforator 41 that creates the tear line 22 shown on back sheet 16 in FIG. 2. However, if the back sheets 16 also must have some non-personalized data printed thereon which is the same for each mailer, a back sheet printer station or step 40 can further be provided to add such information to each back sheet area on web 17 before the web reaches station 41. Such common data could, for example, be instructions or be the address of the mailing entity if the single back sheet 16 is to be returned by the addressee to acknowledge receipt or to serve some other purpose. (E.g. see FIG. 7.)

It should also be noted that the window cutting step 32 of FIG. 4B could be relocated to immediately follow the perforating step 29 in FIG. 4A so as to be part of the on-line process shown in FIG. 4A. In such a modification, however, the speed of web 17 through the illustrated print, punch and perforate stations 27, 28 and 29 would be considerably reduced, thus resulting in a higher cost of performing these particular functions. For example, the speed of web 17 through the stations or steps now shown in FIG. 4A can be up to 800 ft/min., while the maximum speed of web 17 through the stations or steps now shown in FIG. 4B is usually around 100–150 ft/min. because of the longer time need by steps 34 and 35 to affix the inserts 24 and back sheets 16 to the front sheets 15 on web 17. Since a typical die cutter can operate at web speeds from 250 to 300 ft/min., there is no particular drawback in making the window die cutting an on-line step in FIG. 4B whose overall web speed is usually even lower because of the affixing steps. However a window cutting step in the FIG. 4A process would normally require a reduction in web speed therein to around 250–300 ft/min. Moreover, if the front sheets 15 on web 17 are relatively small between their transverse tear lines 14 (e.g., three to four inches) so that windows 23 would be cut by a FIG. 4A step in close proximity to said tear lines, the subsequent and initial fan folding step 30 of web 17 could cause the buckling of web 17 at or near a fold line unless the web speed is limited to about 30–50 ft/min. This is because cross-web rigidity at higher speeds usually cannot be maintained if step 30 initially folds a web having windows too close to the fold lines. In FIG. 4B as shown, however, the refolding step 54 on the now die cut web 17 can be performed at higher web speeds because the "fold memory" characteristic of web 17 permits it to be refolded faster without buckling.

The completely assembled mailers in stack 37 of FIG. 4B are now available as connected segments of a continuous form for personalized printing. At least one area on the top surface of each card insert 24 is accessible through the open window 23 of each mailer for this purpose. The mailer manufacturer or its customer, which could be a membership organization or other entity, can then use these continuous form mailers in a printer operated from a computer or data base whereby personalized information, such as a member name, can be applied through window 23 to the exposed surface area of a card 24 as the form passes through the printer. This final printing operation is depicted in FIG. 4C, which shows the mailers 10 on the continuous web 17 from folded stack 37 being used at a mailer printer station 42. Moreover, while each mailer 10 is at the printer station 42 for the personalized printing of its card insert 24, the printer can also be programmed to apply the same or additional personal data (such as the member's address) to one or more selected areas on the outer surface of the mailer envelope's front sheet 15. FIG. 1 shows how each of three different mailers 10*a*, 10*b* and 10*c* can be printed with different names on their card inserts and different addresses on their envelopes. These and other mailers 10 on web 17 can then be separated from each other and from their strips 11 by a conventional burster station 43. However, for certain applications it may be permissible to send a mailer 10 to an addressee without removing the printer feed holes 12, in which case there may be no need to incorporate the marginal tear lines 13 in front sheet 15. Furthermore, a conventional slitter device may be employed in a well known manner to separate the printer feed holes from front sheet 15, thereby also dispensing with the need for tear lines 13.

Thus, the subject invention permits the individual personalization of both a mailer envelope and its sealed contents at the same time in only one pass through a printer station. This synchronized application of personal data to a mailer in one operation, rather than in separate operations, substantially reduces this printing time. It also eliminates the possibility of mismatching data, such as the wrong address coupled with a particular name, that could result if a card is personalized before being inserted into its mailer envelope.

As noted in connection with FIG. 4B, the insert affixing step 34 and the back sheet affixing step 35 are done on-line so that two separate affixing stations are required. However, these FIG. 4B operations could be performed by two separate procedures in which only one affixing station is required, thus reducing the cost of equipment needed for manufacturing the mailer although increasing the time of its production. This modification is shown by FIGS. 5A and 5B. In FIG. 5A, the web 17 in folded stack 31, which resulted from the FIG. 4A operation, has windows 23 cut therein by station or step 44 and then undergoes step 45 whereby the insert glue dots 25 are applied around each said window. This step is followed by the operation at station 46 wherein the inserts 24 are affixed to web 17 under said windows, afterwhich web 17 is refolded into a stack 48 at station 47. Stack 48 is then taken off-line and, as illustrated in FIG. 5B, is then passed through a glue station 49 for applying the back sheet glue dots 20. This glue station 49 can be the same apparatus that was used for glue step 45 in FIG. 5 A. Web 17, with its previously affixed card inserts 24, next goes from station 49 to station or step 50 where the patch back sheets 16 from web 38 are affixed thereto. Station 50 also can comprise the same equipment used for step 46 in FIG. 5A to affix inserts 24 to web 17. In FIG. 5B, the back sheet supply reel 51, and the print and perforator stations or steps 52 and 53, respectively perform the same functions that were described in connection with 39, 40 and 41 in FIG. 4B. From station 50 in FIG. 5B, the completed web of mailers 10 is refolded into the stack 37 at station 54 which also can be the same folder used for step 47 in FIG. 5A. This stack 37 thereafter can be personalized by the printing operation described in connection with FIG. 4C.

Figure 7:
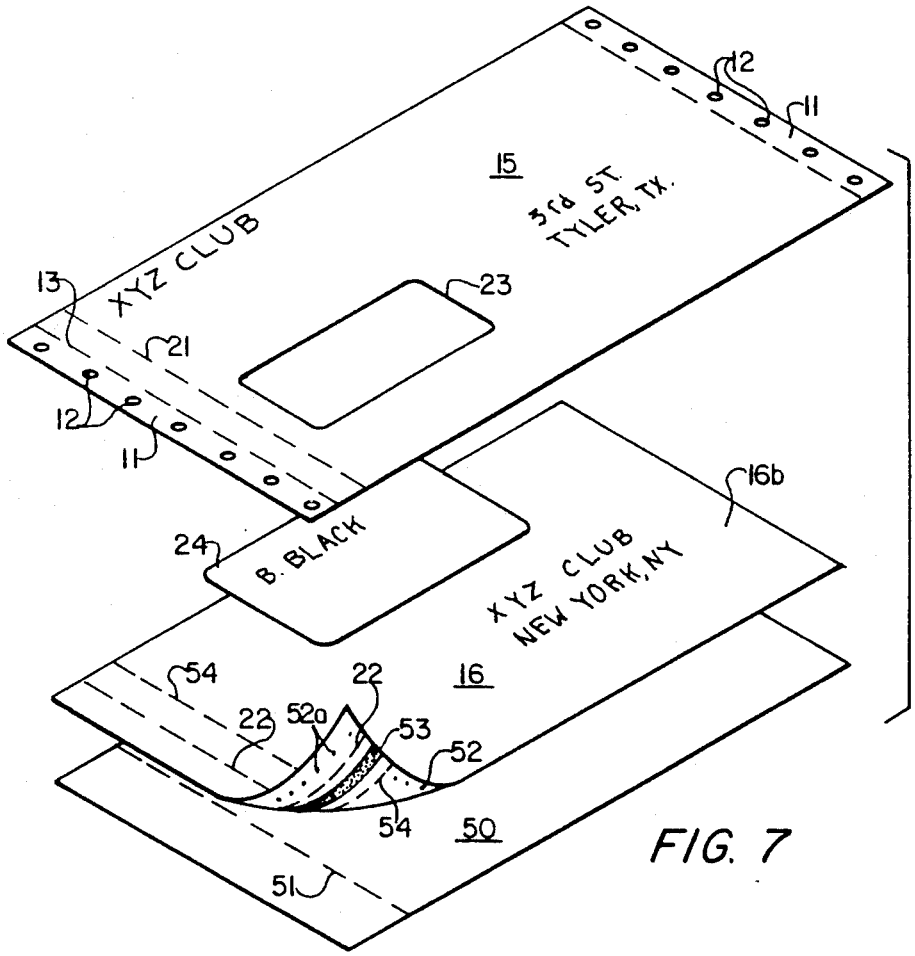
FIG. 7 shows a second embodiment of a mailer wherein an additional patch sheet is attached to the outer surface of a mailer's back sheet for providing a return envelope.

FIG. 7 shows a second embodiment of a mailer according to the present invention. Elements in FIG. 7, which are identical to elements in the mailer embodiment of FIGS. 1-3, are identified by the same numbers and have the same functions. In the FIG. 7 version, however, a patch sheet 50 is attached to the outer surface of back sheet 16 for providing a return envelope that the addressee can use in communicating with the mailing entity when needed. For this purpose, the address of the mailing entity (such as "XYZ Club") is printed on the inner surface 16*b* of sheet 16 as it is when the back sheet 16 of FIG. 2 is used as a return single sheet mailer. Patch sheet 50 is about the same size as back sheet 16 and is also provided with a tear line 51 that is aligned with a fold line 54 on sheet 16 that is near to and spaced inwardly from tear line 22. Sheet 16 and sheet 50 are affixed together by one or more rows of glue dots 52 around at least three edges of sheet 16 on its outer surface 16*a*, and also can be so bonded by a series of glue dots 52*a* located between tear line 22 and the adjacent fourth edge. The glue of dots 52, 52*a* permanently binds together the edges of sheets 16 and 50 and can be of a type like a H.B. Fuller S 3307 glue. A pressure sensitive or moistenable glue strip 53 is also provided on sheet 16 between tear line 22 and fold line 54. Thus, when the addressee pulls and ruptures tear lines 21, 22 and 51 to remove insert card 24 and peel away back sheet 16 from front sheet 15, sheets 16 and 50 remain permanently bonded together along three edges to thereby form a return envelope configuration. However, their fourth edges along tear lines 22 and 51 may now be opened to insert materials therein and then sealed by folding over strip 53 to the outer surface of patch 50 before mailing. In manufacturing the mailer embodiment of FIG. 7, sheets 16 and 50 can be bonded together prior to affixing back sheet 16 to front sheet 15. Commercially available apparatus for this prior bonding of sheets 16 and 50 can be, for example, a Tamarak Pattern Glue Applicator and a Hamilton HILINE Collator.

Many modifications and variations of the present invention are possible considering the above teachings and specifications. Therefore, within the scope of the appended claims, the invention may be practiced otherwise than as specifically described above.

We claim:

1. A mailer configuration comprising:

(a) A front outside sheet member having outer and inner surfaces, said front sheet being bounded by a top edge, a bottom edge, and left and right marginal edges;

(b) left and right marginal tear lines on said front sheet which extend between said top and bottom edges, each said left and right marginal tear line being near to and spaced inwardly from said left and right marginal edges, respectively, so as to create left and right marginal strips that can be separated from the rest of said front sheet;

(c) a series of printer feed holes in each of said marginal strips;

(d) an envelope opening tear line on said front sheet which extends between said top and bottom edges, said envelope opening tear line being near to and spaced inwardly from one of said marginal tear lines;

(e) an open window in said front sheet which is positioned between said envelope opening tear line and the other one of said marginal tear lines;

(f) a back outside sheet member having outer and inner surfaces, said back sheet being bounded by a top edge, a bottom edge, and left and right side edges, where the distance between said back sheet side edges is not greater than the distance between said front sheet marginal tear lines and the distance between said back sheet top and bottom edges is not greater than the distance between said front sheet top and bottom edges;

(g) first removable adhesive means for removably affixing the periphery of the inner surface of said back sheet around all four edges thereof to the inner surface of said front sheet so that said back sheet totally lies between said front sheet marginal tear lines and forms a sealed mailer envelope in combination with said front sheet;

(h) an envelope opening tear line on said back sheet extends between said top and bottom edges, said back sheet tear line being near to and spaced inwardly from one of said back sheet's side edges so as to be at least approximately aligned with said envelope opening tear line on said front sheet;

(i) an insert sheet member located between said front and back sheets which is positioned under said front sheet open window so that said insert sheet is visible through said window, said insert sheet being larger than said window but smaller than said back sheet; and (j) second removable adhesive means for removably affixing said insert sheet to the inner surface of at least one of said front and back sheets.

2. The mailer configuration according to claim 1, wherein said first adhesive means is formed as a series of discrete dots on the inner surface of said front sheet.

3. The mailer configuration according to claim 2, wherein said discrete adhesive dots are spaced around said top and bottom edges of said front sheet and inwardly of its said marginal tear lines.

4. The mailer configuration according to claim 3, wherein said envelope opening tear line on said front sheet is spaced inwardly of said discrete adhesive dots.

5. A mailer configuration comprising:

(a) A front outside sheet member having outer and inner surfaces, said front sheet being bounded by a top edge, a bottom edge, and left and right marginal edges;

(b) left and right marginal tear lines on said front sheet which extend between said top and bottom edges, each said left and right marginal tear line being near to and spaced inwardly from said left and right marginal edges, respectively, so as to create left and right marginal strips that can be separated from the rest of said front sheet;

(c) a series of printer feed holes in each of said marginal strips;

(d) an envelope opening tear line on said front sheet which extends between said top and bottom edge, said envelope opening tear line being near to and spaced inwardly from one of said marginal tear lines;

(e) an open window in said front sheet which is positioned between said envelope opening tear line and the other one of said marginal tear lines;

(f) a back outside sheet member having outer and inner surfaces, said back sheet being bounded by a top edge, a bottom edge, and left and right side edges, where the distance between said back sheet side edges is not greater than the distance between said front sheet marginal tear lines and the distance between said back sheet top and bottom edges is not greater than the distance between said front sheet top and bottom edges;

(g) first removable adhesive means for removably affixing the periphery of the inner surface of said back sheet around all four edges thereof to the inner surface of said front sheet so that said back sheet totally lies between said front sheet marginal tear lines and forms a sealed mailer envelope in combination with said front sheet, wherein said first adhesive means is formed as a series of discrete dots on the inner surface of said front sheet which are spaced around said top and bottom edges of said front sheet and inwardly of its said marginal tear lines, and said envelope opening tear line on said front sheet is spaced inwardly of said discrete adhesive dots;

(h) an envelope opening tear line on said back sheet which extends between said top and bottom edges, said back sheet tear line being near to and spaced inwardly from one of said back sheet's side edges so as to be at least approximately aligned with said envelope opening tear line on said front sheet;

(i) an insert sheet member located between said front and back sheets which is positioned under said front sheet open window so that said insert sheet is visible through said window, said insert sheet being larger than said window but smaller than said back sheet; and (j) second removable adhesive means for removably affixing said insert sheet to the inner surface of said front sheet, wherein said second adhesive means is formed as a series of discrete dots on the inner surface of said front sheet which are spaced at least partially around its said window.

6. The mailer configuration according to claim 1, wherein the distance between said back sheet side edges is less than the distance between said front sheet marginal tear lines.

7. The mailer configuration according to claim 1, which further includes a patch sheet member permanently affixed to the outer surface of said back sheet around at least three edges thereof so as to form a return envelope between said patch sheet and said back sheet.

8. The mailer configuration according to claim 7, wherein envelope sealing means is provided between said patch sheet and said back sheet near a fourth edge thereof.

9. A continuous web of plural, physically connected mailer configurations, each said mailer configuration comprising:

(a) a front outside sheet member having outer and inner surfaces, said front sheet being bounded by a transverse top edge, a transverse bottom edge, and longitudinal left and right marginal edges, where each of said transverse edges is connected along a tear line to a transverse edge of an adjacent mailer configuration;

(b) left and right marginal tear lines on said front sheet which extend between said transverse top and bottom edges, each said left and right marginal tear line being near to and spaced inwardly from said left and right marginal edges, respectively, so as to create left and right marginal strips that can be separated from the rest of said front sheet;

(c) a series of printer feed holes in each of said marginal strips;

(d) an envelope opening tear line on said front sheet which extends between said transverse top and bottom edges, said envelope opening tear line being near to and spaced inwardly from one of said marginal tear lines;

(e) an open window in said front sheet which is positioned between said envelope opening tear line and the other one of said marginal tear lines;

(f) a back outside sheet member having outer and inner surfaces, said back sheet being bounded by a top edge, a bottom edge, and left and right side edges, where the distance between said back sheet side edges is not greater than the distance between said front sheet marginal tear lines and the distance between said back sheet top and bottom edges is not greater than the distance between said front sheet transverse top and bottom edges;

(g) first removable adhesive means for removably affixing the periphery of the inner surface of said back sheet around all four edges thereof to the inner surface of said front sheet so that said back sheet totally lies between said front sheet marginal tear lines and forms a sealed mailer envelope in combination with said front sheet;

(h) an envelope opening tear line on said back sheet which extends between said top and bottom edges, said back sheet tear line being near to and spaced inwardly from one of said back sheet's side edges so as to be at least approximately aligned with said envelope opening tear line on said front sheet;

(i) an insert sheet member located between said front and back sheets which is positioned under said front sheet open window so that said insert sheet is visible through said window, said insert sheet being larger than said window but smaller than said back sheet; and (j) second removable adhesive means for removably affixing said insert sheet to the inner surface of said front back sheets.

10. The mailer configuration according to claim 9, wherein said first adhesive means is formed as a series of discrete dots on the inner surface of said front sheet.

11. The mailer configuration according to claim 10, wherein said discrete adhesive dots are spaced around said top and bottom edges of said front sheet and inwardly of its said marginal tear lines.

12. The mailer configuration according to claim 11, wherein said envelope opening tear line on said front sheet is spaced inwardly of said discrete adhesive dots.

* * * * *